US005599377A

United States Patent [19]

Uenosono et al.

[11] Patent Number: 5,599,377

[45] Date of Patent: Feb. 4, 1997

[54] MIXED IRON POWDER FOR POWDER METALLURGY

[75] Inventors: Satoshi Uenosono; Kuniaki Ogura, both of Chiba, Japan

[73] Assignee: Kawasaki Steel Corporation, Japan

[21] Appl. No.: 506,127

[22] Filed: Jul. 24, 1995

[30] Foreign Application Priority Data

Jul. 28, 1994 [JP] Japan ..... 6-176311
Dec. 16, 1994 [JP] Japan ..... 6-313360

[51] Int. Cl.[6] ..... C22C 38/12

[52] U.S. Cl. ..... 75/252; 75/232; 75/234; 75/254

[58] Field of Search ..... 75/252, 254, 232, 75/234

[56] References Cited

U.S. PATENT DOCUMENTS 4,098,608 7/1978 Matty et al. ..... 75/254
4,859,238 8/1989 Weise et al. ..... 75/232
5,356,453 10/1994 Takata ..... 75/254

*Primary Examiner*—George Wyszomierski
*Attorney, Agent, or Firm*—Austin R. Miller

[57] ABSTRACT

A mixed iron powder for powder metallurgy containing less than about 0.1 wt % of Mn, about 0.08 to 0.15 wt % of S, a total of about 0.05 to 0.70 wt % of one or more compounds selected from $MoO_3$ and $WO_3$, about 0.50 to 1.50 wt % of graphite powder, and the balance Fe and incidental impurities. The mixed iron powder can be manufactured by an atomizing process using water, and be used to manufacture a sintered steel having excellent machinability, strength and toughness without forming soot, even if sintered in a hydrogen-containing atmosphere.

8 Claims, No Drawings

MIXED IRON POWDER FOR POWDER METALLURGY

BACKGROUND OF THE INVENTION

1. Field of the Invention

The present invention relates to a mixed iron powder for powder metallurgy to be used in a sintered steel having excellent machinability.

2. Description of the Related Art

A mixed iron powder for powder metallurgy is prepared by incorporating a copper powder, a graphite powder, etc. in an iron powder, pressing the mixture in a die and then sintering the press-molded mixture. The mixed iron powder is used for manufacturing sintered machine parts typically having a density between 5.0–7.2 g/cm$^3$.

A sintered compact having excellent dimensional accuracy and a complicated shape may be manufactured by a powder metallurgy method. However, in order to manufacture parts having even greater dimensional accuracy, machining of the parts such as shaving or drilling is needed after sintering. Such a case therefore requires that the parts possess excellent machinability.

In general, powder metallurgical products suffer from inferior machinability, which shortens tool life (as compared with an ingot material product) and increases machining cost. It has been thought that the inferior machinability of the powder metallurgical product is caused by interrupted cutting during machining due to the pore structure present in the powder metallurgical product, or from an increase in cutting temperature due to a reduction in thermal conductivity.

Improving the machinability of a powder metallurgical product has been conventionally accomplished by incorporating free-cutting components such as S and MnS into the iron powder. It has been thought that S and MnS facilitate the fracture of chips, thus forming a thin built-up edge which lubricates the rake face of a machining tool, thereby improving machinability.

The only method of incorporating S or MnS in an iron powder is to mix Mn, S or MnS in a molten steel, and thereafter atomizing the mixed molten steel.

Japanese Patent Publication No. 3-25481 discloses an iron powder for powder metallurgy composed of a molten steel containing 0.1 to 0.5 wt % of Mn, Si and C, and 0.03 to 0.07 wt % of S, which involves water or gas atomizing of the molten steel. However, this method only improves machinability by a little under two times that of conventional materials.

Japanese Patent Publication No. 4-72905 discloses free-cutting sintered forged parts containing at least two metals among 0.1 to 0.9 wt % of Mn, 0.1 to 1.2 wt % of Cr, 0.1 to 1.0 wt % of Mo, 0.1 to 2.0 wt % of Cu and 0.1 to 2.0 wt % of Ni; and one or more metals among Nb, Al and V; S; C and Si.

Since the sintered forged parts nearly attain true density, they have almost no pores, and consequently there may be less deterioration in machinability. However, common sintered parts having pores and with a density of 5.0 to 7.2 g/cm$^3$ are not disclosed.

Japanese Patent Laid-Open Publication No. 61-253301 discloses an alloy steel powder containing 0.10% or less of C; 2.0% or less of Mn; 0.30% or less of oxygen; one or more elements among 0.10 to 5.0% of Cr, 0.10 to 5.0% of Ni, 2.0% or less of Si, 0.10 to 10.0% of Cu, 0.01 to 3.0% of Mo, 0.01 to 3.0% of W, 0.01 to 2.0% of V, 0.005 to 0.50% of Ti, 0.005 to 0.50% of Zr, 0.005 to 0.50% of Nb, 0.03 to 1.0% of P and 0.0005 to 1.0 % of B; 1.0% or less of S, as needed; and the balance substantially Fe.

However, the alloy steel powder contains a high Cr ratio of 0.10% or more. In addition, in order to obtain the above-described composition, a water-atomized master alloy powder is incorporated in powder obtained by roughly reducing iron oxide (such as iron ore and mill scale) with a reducing agent of a coke breeze. The quantity of the master alloy powder is adjusted so as to obtain a desired amount of alloying element after finishing reduction, and then the mixed powder is subjected to finishing reduction in a reduced atmosphere. As a result, the alloy steel powder is very expensive because it undergoes a complicated manufacturing process. In addition, the basic properties of the powder, such as compressibility and the like, are insufficient to put the alloy steel into practical use.

Japanese Patent Laid-Open Publication No. 6-41609 discloses a method of manufacturing a sintered member in which powders of oxides composed of elements having an absolute value of standard free energy for forming oxides larger than 120 Kcal/mol $O_2$ (e.g., $Al_2O_3$, $TiO_2$ and $SiO_2$), are added to a mixture of iron powder, graphite powder and copper powder. However, since these oxides are very solid and stable, they are not reduced during sintering, thus an improvement in machinability cannot be expected.

SUMMARY OF THE INVENTION

It is an object of the present invention to provide a mixed iron powder for powder metallurgy suitable for manufacturing a sintered steel exhibiting excellent machinability, even when an iron powder containing S and manufactured by an atomizing process using water is sintered in a hydrogen-containing atmosphere.

According to one aspect of the present invention, there is provided a mixed iron powder for powder metallurgy containing less than about 0.1 wt % of Mn, about 0.08 to 0.15 wt % of S; a total of about 0.05 to 0.70 wt % of at least one of $MoO_3$ and $WO_3$; about 0.50 to 1.50 wt % of graphite powder and the balance Fe.

According to another aspect of the present invention, there is provided a mixed iron powder for powder metallurgy containing less than about 0.1 wt % of 10 Mn, a total of about 0.03 to 0.15 wt % of one or more elements selected from S, Se and Te; a total of about 0.05 to 0.70 wt % of at least one of $MoO_3$ and $WO_3$; about 0.50 to 1.50 wt % of graphite powder; and the balance Fe.

Other objects and aspects of the present invention will become apparent from the following description and claims.

DETAILED DESCRIPTION OF THE INVENTION

The present invention is characterized in that machinability of a sintered steel is improved by adding oxides to an iron powder for powder metallurgy.

We investigated the cause of machinability deterioration when iron powder containing S and manufactured by an atomizing process using water was sintered in a hydrogen-containing atmosphere. We discovered that when the iron powder containing about 0.08 to 0.15 wt % of S and manufactured by an atomizing process using water is sintered in a hydrogen-containing nitrogen atmosphere, the quantity of residual graphite in the pores of the sintered steel and the quantity of S in the sintered steel were decreased as compared with the sintered steel sintered in a pure nitrogen atmosphere. We also discovered that the ratio of pearlite in the ferrite-pearlite structure was increased.

These findings revealed that when iron powder is sintered in a hydrogen-containing nitrogen atmosphere, FeS contained in the powder is reduced by hydrogen to accelerate carburizing the graphite into the iron powder during sintering. Thus, the ratio of pearlite is increased and the amount of residual graphite is decreased, thereby deteriorating machinability. However, even if MnS is contained in the iron powder in place of FeS, it does not decrease carburizing of the steel, nor does it increase the amount of residual graphite left in the pores of the sintered steel.

We also discovered that the addition of compounds which stimulate the formation of ferrite, thereby increasing the ferrite ratio, is useful for manufacturing a sintered steel having excellent machinability even when sintered in a hydrogen-containing atmosphere. We found that suitably dispersing a relatively soft ferrite in a hard pearlite is essential to improving machinability. The present invention is based on this discovery.

In the present invention, ferrite-pearlite structures with a large ratio of ferrite and containing about 0.05 wt % of graphite are obtained by adding Mo in the form of $MoO_3$ together with graphite powder to iron powder. Sintered steels made from such powders possess excellent machinability, even when sintering is performed in a hydrogen-containing atmosphere. $MoO_3$ is reduced during sintering and is dissolved as Mo in gamma-iron particles as represented by the following reaction:

$$MoO_3+3C \rightarrow Mo+3CO \quad (1)$$

The reaction (1) decreases the amount of C in Fe while increasing the amount of ferrite.

Generally, when the ferrite ratio is increased in a ferrite-pearlite steel, the strength of the steel is lowered. In the present invention, however, strength is increased by the dissolving of Mo in ferrite particles, thereby creating a sintered body with excellent machinability and having strength of about 400 to 600 MPa, depending on the amount of $MoO_3$ added.

We found that since $MoO_3$ powder is more likely to be decomposed by $H_2$ rather than FeS during sintering, and is dissolved in the iron particles after decomposition, the addition of $MoO_3$ powder increases the amount of the residual graphite and improves machinability more than the addition of Mo to iron powder by alloying and atomizing. Moreover, $MoO_3$ reacts with $H_2$ to substantially reducing the partial pressure of $H_2$.

Furthermore, on the basis of the above-described discoveries, we looked for oxides which were easily reduced by hydrogen and that were dissolved in the base of the sintered body after reduction. We discovered that WO3 increases the ratio of ferrite while creating a solidsolution strengthening effect, thus improving machinability much like $MoO_3$.

That is, ferrite-pearlite structures having a large ratio of ferrite and containing about 0.05 wt % of residual graphite can be obtained by adding one or both of $MoO_3$ and $WO_3$ together with graphite powder to iron powder. A product with excellent machinability is obtainable even when the powder mixture is sintered in a hydrogen-containing atmosphere. In particular, through dissolution of Mo or W reduced by hydrogen in the gamma-iron, a sintered body having excellent machinability as well as having strength of about 400 to 600 MPa can be obtained.

In addition, we have investigated alloying elements other than S which prevent carburizing during sintering and increase the amount of residual graphite. As a result, we found that S, Se and Te, which have less solubility in iron contained in ingot materials and which tend to be segregated on grain boundaries, each have the effect of increasing residual graphite. We have also discovered that B, Cr and Mo have the effect of increasing residual graphite when used in combination with S, Se and/or Te, and that Mn has the effect of reducing the amount of residual graphite.

Moreover, we have found that the quantity of residual graphite in the sintered steel is further increased and machinability is remarkably improved by adding additional amounts of Cr and B to the iron powder containing less than about 0.1% of Cr, S, Se and Te.

In particular, when a molten steel containing B is water atomized, some of the B is easily oxidized by water to deposit B-series oxides on the surface of the iron powder, whereby the B-series oxides limit carburizing of graphite into iron powder during sintering. Thus, it is the B-series oxides which have the effect of increasing the amount of residual graphite in the sintered steel. Therefore, even if Fe-B powder is incorporated into iron powder containing no B, machinability will not be improved because B-series oxides must be present to positively affect machinability.

Since the B-series oxides are very stable and hardly react with $H_2$, machinability of the iron powder is not deteriorated.

It is important to define the quantity ranges and describe the functions of elemental components of the mixed iron powder of the present invention. Such description is provided below.

Mn: less than about 0.1 wt %

The amount of Mn in the iron powder for powder metallurgy is limited to less than about 0.1 wt %. If Mn constitutes about 0.1 wt % or more of the iron powder, the sintered steel retains less residual graphite, thus deteriorating machinability. This is because Mn itself is an alloying element which reduces the quantity of residual graphite, and also because Mn bonds easily with S, Se and Te to reduce the quantities of S, Se and Te available to increase the amount of residual graphite in the sintered steel. In view of the refining costs associated with the reduction of Mn in a converter and its effect on machinability, the preferable range of the Mn content is about 0.04 to 0.08 wt %.

S: about 0.08 to 0.15 wt %

The amount of S in the iron powder for powder metallurgy is limited to about 0.08 to 0.15 wt %, preferably about 0.10 to 0.13 wt %. S is contained in the iron powder as a source of FeS, controls carburizing, and ensures at least about 0.05 wt % of residual graphite even when the iron powder is sintered in a hydrogen-containing atmosphere. When S content is less than about 0.08 wt %, the sintered steel retains less residual graphite and machinability is deteriorated. When the content of S exceeds about 0.15 wt %, furnace-damaging soot is apt to be formed during sintering.

Total amount of one or more of S, Se and Te: about 0.03 to 0.15 wt %

S, Se and Te are added to the iron powder to increase the quantity of residual graphite in the sintered steel. The total amount of one or more of the three elements to be added is limited to about 0.03 to 0.15 wt %. If the content of one or more elements among S, Se and Te is less than about 0.03 wt %, the effect of increasing the residual graphite is insufficient. If the content exceeds about 0.15 wt %, furnace-damaging soot is apt to be formed during sintering. Considering the effect on machinability as well as the cost of the alloy, a preferable quantity range is about 0.08 to 0.13 wt %.

Cr: about 0.02 to 0.07 wt %

Cr is added to the iron powder to increase the amount of the residual graphite formed by S, Se and Te, thus further improving machinability. The quantity of Cr to be added is limited to about 0.02 to 0.07 wt %. When the Cr content is less than about 0.02 wt %, no improvement in machinability from the addition of Cr is realized. When the Cr content exceeds about 0.07 wt %, the formation of a carbide increases the hardness of the sintered steel, thereby deteriorating machinability. Considering the effect on machinability and the alloy cost, a preferable Cr content range is about 0.04 to 0.06 wt %.

B: about 0.001 to 0.03 wt %

B is added to the iron powder to increase the amount of residual graphite formed by S, Se and Te, thus further improving machinability. When a molten steel containing B is water-atomized, some of the B is easily oxidized by water whereby B-series oxides are deposited on the iron powder surface. The B-series oxides limit the carburizing of graphite into the iron powder during sintering. Thus, it is the B-series oxides which have the effect of increasing the amount of residual graphite in the sintered steel. Therefore, even if Fe-B powder is incorporated into iron powder which does not contain B, machinability will not be improved because B-series oxides must be present to positively affect machinability. When the content of B is less than about 0.001 wt %, improvement of machinability due to the addition of Cr is not realized. When the content of B exceeds about 0.03 wt %, hardness of the sintered steel increases due to solid-solution hardening, thereby deteriorating machinability. With a view to balancing machinability and the cost of the alloy, a preferable B content range is about 0.002 to 0.01 wt %.

Total quantity of one or both of $MoO_3$ powder and $WO_3$ powder: about 0.05 to 0.70 wt %

$MoO_3$ powder and $WO_3$ powder are added to the iron powder to improve machinability and increase strength through solid-solution strengthening. When the total content of $MoO_3$ powder and/or $WO_3$ powder is less than about 0.05 wt %, the effect of improved machinability and strength is not realized. When the content of the same exceeds about 0.70 wt %, bainite is formed whereby strength is reduced.

Graphite powder: about 0.5 to 1.50 wt %

A graphite powder is added to the iron powder as a graphite source for leaving residual graphite in pores of the sintered steel to improve machinability. Some of the added graphite powder also dissolves in the iron powder during sintering to increase strength of the sintered steel. When the graphite powder content is less than about 0.5 wt %, strength of the sintered steel is deteriorated. On the other hand, when the graphite powder content exceeds about 1.5 wt %, the pearlite ratio is increased which deteriorates machinability. Therefore, the graphite powder content is limited to a range of about 0.5 to 1.50 wt %.

Copper powder: about 0.50 to 4.0 wt %

A copper powder is added to the iron powder so as to increase strength of a sintered body without deteriorating machinability thereof. When the content of copper powder is less than about 0.5 wt %, no strengthening is observed. When the copper powder content exceeds about 4.0 wt %, machinability and impact strength of the sintered steel are deteriorated.

Prior to adding the graphite, copper, $MoO_3$ and/or $WO_3$ powders to the iron powder, it is preferable to subject them to segregation prevention treatment before the mixing into the iron powder. Since a segregation prevention treatment enables a homogeneous mixing of $MoO_3$ powder and $WO_3$ powder into the iron powder, Mo and W are more homogeneously dissolved in the iron powder during sintering as compared with a simple mixing method. As a result, a fine ferrite phase is obtained after sintering, and the strength of the sintered steel is increased by about 15 % as compared with the simple mixing method.

The invention will now be described through illustrative examples. The examples are not intended to limit the scope of the invention defined in the appended claims.

EXAMPLE 1

Raw powders of various compositions were obtained by water-atomizing a molten steel, then drying the steel in a nitrogen atmosphere at 140° C. for 60 minutes, and thereafter reducing the steel in a pure hydrogen atmosphere at 930° C. for 20 minutes, followed by pulverization to form iron powders. The chemical composition of each iron powder is shown in Table 1.

TABLE 1

(wt %)

| Iron powder | Mn | S | Cr | Fe | Note |
|---|---|---|---|---|---|
| 1 | 0.05 | 0.15 | | Balance | Example |
| 2 | 0.04 | 0.09 | 0.08 | Balance | |
| 3 | 0.06 | 0.08 | 0.15 | Balance | |
| 4 | 0.17 | 0.10 | 0.12 | Balance | Comparative |
| 5 | 0.04 | 0.01 | | Balance | Example |
| 6 | 0.08 | 0.35 | 0.05 | Balance | |

A graphite powder having a mean particle diameter of 10 μm and $MoO_3$ powder having a mean particle diameter of 5 μm were mixed into the thusly-prepared iron powders in combinations and quantities shown in Table 2. A copper powder having a mean particle diameter of 20 μm was also mixed into some of the powder mixtures as shown in Table 2. 1 wt % of zinc stearate was added to all of the mixed powders, and the mixtures were blended for 15 minutes with a V-blender to obtain molded articles having a green density of 6.85 g/cm$^3$. The molded articles were then sintered in a stream of nitrogen containing 10 % hydrogen at a temperature of 1,130° C. for 20 minutes. The gas flow rate during sintering was 5 Nl/min per 1 kg of the molded articles. The tensile strength and Charpy absorbed energy of each of the sintered steels were measured, and the results thereof are shown in Table 2 together with the presence or absence of soot formed during sintering.

TABLE 2

| Classification | Iron powder No. | $MoO_3$ wt % | Graphite wt % | Copper powder wt % | Drill life* (Total number of drilled holes) | Strength (MPa) | Impact value (J) | Formation of soot |
|---|---|---|---|---|---|---|---|---|
| Example 1 | 1 | 0.06 | 1.4 | | 720 | 400 | 12 | NO |
| Example 2 | 3 | 0.15 | 0.8 | 2.0 | 815 | 440 | 13 | NO |
| Example 3 | 1 | 0.20 | 0.8 | | 820 | 400 | 14 | NO |
| Example 4 | 2 | 0.30 | 1.0 | 1.5 | 805 | 470 | 14 | NO |
| Example 5 | 1 | 0.50 | 0.55 | | 780 | 410 | 15 | NO |
| Example 6 | 2 | 0.60 | 1.0 | | 805 | 430 | 15 | NO |
| Example 7 | 1 | | 0.8 | | 730 | 400 | 12 | NO |
| Example 8 | 2 | | 0.8 | 2.5 | 800 | 440 | 12 | NO |
| Example 9 | 3 | | 1.0 | 2.0 | 810 | 540 | 13 | NO |
| Example 10 | 1 | 0.3 | 0.8 | 2.0 | 615 | 470 | 13 | NO |
| Comparative Example 1 | 2 | 0.04 | 0.8 | | 35 | 370 | 10 | NO |
| Comparative Example 2 | 3 | 0.80 | 1.0 | 2.0 | 105 | 650 | 16 | NO |
| Comparative Example 3 | 1 | 0.10 | 0.4 | | 320 | 280 | 14 | NO |
| Comparative Example 4 | 2 | 0.30 | 1.6 | 2.0 | 200 | 480 | 11 | NO |
| Comparative Example 5 | 2 | 0.30 | 1.0 | 4.5 | 720 | 450 | 6 | NO |
| Comparative Example 6 | 4 | 0.40 | 0.8 | 2.0 | 150 | 500 | 13 | NO |
| Comparative Example 7 | 5 | 0.20 | 1.0 | 1.5 | 40 | 440 | 12 | NO |
| Comparative Example 8 | 6 | 0.10 | 1.0 | 2.0 | 700 | 430 | 13 | YES |

*: Total number of holes the drill could bore before the drill became unusable.

Machinability was evaluated in the following manner. The disk-like molded articles, each having an outer diameter of 60 mm, height of 10 mm and green density of 6.85 g/m$^3$, were sintered under the conditions as described above, and then drilled by a high-speed steel drill at 10,000 rpm and 0.012 mm/rev. The average number of holes (mean value of three drills) which could be drilled in the molded articles until drilling became impossible was measured as the tool life of the drills, reflecting the machinability of the sintered steels (greater tool life-greater machinability).

It is apparent from Examples 1 to 10 in Table 2 (in conjunction with Table 1) that sintered steels having excellent machinability within a tensile strength range from about 400 to 580 MPa can be obtained by molding and sintering two kinds of iron powder: one kind which incorporates about 0.05 to 0.70 wt % of $MoO_3$ and about 0.5 to 1.50 wt % of graphite powder into an iron powder for powder metallurgy containing less than about 0.1 wt % of Mn and about 0.08 to 0.15 wt % of S; and the other kind which further incorporates about 0.5 to 4.0 wt % of a copper powder to the above-described mixed powder.

A powder containing 1% of zinc stearate and only 1.0 wt % of graphite powder was incorporated in the iron powder No. 1 in Table 1, was molded and then sintered in a stream of nitrogen containing 10% of hydrogen at 1,130° C. for 20 minutes. The number of drilled holes in the comparative sintered steel was only 15.

As revealed by Comparative Examples 1 and 2 in Table 2, if the amount of $MoO_3$ in the mixed iron powder is less than about 0.05 wt %, or more than about 0.70 wt %, machinability is deteriorated. As revealed by Comparative Examples 3 and 4 in Table 2, if the amount of graphite in the mixed iron powder is less than about 0.50 wt %, the strength of the sintered steel is low, while the machinability of the sintered steel is deteriorated if the amount of graphite exceeds about 1.50 wt %. As shown in Comparative Example 5, if the amount of copper powder in the mixed iron powder exceeds about 4.0 wt %, the impact value suffers. As shown in Comparative Examples 6, 7 and 8 in Table 2 in conjunction with Table 1, if the content of Mn in the mixed iron powder is about 0.1 wt % or more, or if the content of S is less than about 0.08 wt %, machinability is deteriorated; if the content of S exceeds about 0.15 wt %, soot is formed in the sintered steel which can contaminate a sintering furnace.

EXAMPLE 2

Raw powders of various compositions were obtained by water-atomizing a molten steel, then drying the steel in a nitrogen atmosphere at 140° C. for 60 minutes, and thereafter reducing the steel in a pure hydrogen atmosphere at 930° C. for 20 minutes, followed by pulverization to form iron powders. The chemical composition of each iron powder is shown in Table 3-1 (examples of the invention) and Table 3-2 (comparative examples).

TABLE 3-1

| | Examples of the Invention | | | | | | | | | | | | | | |
|---|---|---|---|---|---|---|---|---|---|---|---|---|---|---|---|
| | Composition (wt %) | | | | | | | | | | | Drill life* | | | |
| | Atomized powder | | | | | | $MoO_3$ pow- | $Wo_3$ pow- | Cu pow- | Graphite pow- | Residual | (Total number of | Tensile strength | Impact value | Forma- tion of |
| No. | B | S | Se | Te | Cr | Mn | der | der | der | der | graphite | drilled holes) | (MPa) | (J) | soot |
| 11 | | 0.03 | | | | 0.07 | | 0.05 | 2 | 1 | 0.40 | 970 | 410 | 12 | NO |
| 12 | 0.006 | 0.06 | | | 0.06 | 0.03 | 0.05 | | | 1 | 0.41 | 1020 | 400 | 12 | NO |
| 13 | | | 0.04 | | | 0.07 | | 0.70 | | 0.8 | 0.41 | 950 | 590 | 11 | NO |
| 14 | 0.020 | | 0.08 | | 0.06 | 0.05 | 0.3 | | 1.5 | 1 | 0.42 | 900 | 450 | 13 | NO |
| 15 | 0.005 | | | 0.07 | 0.03 | 0.08 | 0.1 | | 2 | 1 | 0.40 | 930 | 440 | 11 | NO |

TABLE 3-1-continued

| | Examples of the Invention | | | | | | | | | | | | | | |
|---|---|---|---|---|---|---|---|---|---|---|---|---|---|---|---|
| | Composition (wt %) | | | | | | | | | | | Drill life* | | | |
| | Atomized powder | | | | | | $MoO_3$ pow- | $Wo_3$ pow- | Cu pow- | Graphite pow- | Residual | (Total number of | Tensile strength | Impact value | Forma- tion of |
| No. | B | S | Se | Te | Cr | Mn | der | der | der | der | graphite | drilled holes) | (MPa) | (J) | soot |
| 16 | | 0.02 | 0.02 | | | 0.06 | 0.6 | | | 1 | 0.40 | 960 | 620 | 11 | NO |
| 17 | 0.004 | 0.05 | 0.04 | 0.03 | 0.04 | 0.04 | 0.2 | 0.05 | 2 | 1 | 0.40 | 900 | 480 | 12 | NO |
| 18 | 0.006 | 0.02 | 0.02 | | 0.05 | 0.06 | 0.1 | | | 1 | 0.041 | 900 | 310 | 12 | NO |

*: Total number of holes the drill could bore before the drill became unusable.

TABLE 3-2

| | Comparative Examples | | | | | | | | | | | | | | |
|---|---|---|---|---|---|---|---|---|---|---|---|---|---|---|---|
| | Composition (wt %) | | | | | | | | | | | Drill life* | | | |
| | Atomized powder | | | | | | $MoO_3$ pow- | $Wo_3$ pow- | Cu pow- | Graphite pow- | Residual | (Total number of | Tensile strength | Impact value | Forma- tion of |
| No. | B | S | Se | Te | Cr | Mn | der | der | der | der | graphite | drilled holes) | (MPa) | (J) | soot |
| 10 | 0.005 | 0.06 | | | 0.06 | 0.05 | 1 | | 2 | 1 | 0.41 | 90 | 710 | 13 | NO |
| 11 | 0.006 | | 0.04 | | 0.06 | 0.08 | | 0.02 | 2 | 1 | 0.29 | 780 | 380 | 11 | NO |
| 12 | 0.020 | | | 0.04 | 0.06 | 0.09 | | 0.80 | 2 | 1 | 0.41 | 80 | 690 | 11 | NO |
| 13 | | 0.08 | | | | 0.06 | 0.2 | | 2 | 1 | 0.24 | 510 | 480 | 12 | NO |
| 14 | 0.010 | 0.02 | | | 0.04 | 0.04 | | 0.10 | 2 | 1 | 0.03 | 25 | 420 | 12 | NO |
| 15 | 0.004 | | 0.02 | | 0.06 | 0.04 | | | 2 | 1 | 0.02 | 30 | 480 | 10 | NO |
| 16 | 0.010 | 0.01 | 0.01 | | 0.06 | 0.05 | 0.2 | | 2 | 1 | 0.04 | 40 | 490 | 12 | NO |
| 17 | 0.005 | 0.17 | | | 0.05 | 0.06 | | 0.20 | 2 | 1 | 0.41 | 920 | 480 | 11 | YES |
| 18 | 0.005 | | | 0.17 | 0.06 | 0.05 | | | 2 | 1 | 0.41 | 930 | 510 | 12 | YES |
| 19 | 0.010 | 0.08 | | 0.08 | 0.05 | 0.07 | 0.1 | 0.10 | 2 | 1 | 0.40 | 950 | 450 | 11 | YES |
| 20 | 0.010 | 0.09 | | | 0.06 | 0.12 | | 0.10 | 2 | 1 | 0.14 | 110 | 450 | 10 | NO |
| 21 | 0.006 | 0.02 | 0.02 | | 0.05 | 0.06 | 0.1 | 0.20 | 2 | 0.3 | 0.03 | 100 | 220 | 12 | NO |

*: Total number of holes the drill could bore before the drill became unusable.

To 100 parts by weight of the mixed iron powders containing no copper powder, and to 100 parts by weight of the mixed iron powders containing copper powder having a mean particle diameter of 20 μm, were added graphite powder having a mean particle diameter of 10 μm, $MoO_3$ powder and $WO_3$ powder each having a mean particle diameter of 5 μm, each in the quantities shown in Tables 3-1 and 3-2. 1 wt % of zinc stearate was added to all of the mixed iron powders. The mixed iron powders were blended with a V-blender for 15 minutes. Then, the mixtures were molded to have a green density of 6.85 g/cm$^3$, then the molded articles were sintered in a stream of nitrogen containing 10 wt % of hydrogen at 1,130° C. for 20 minutes. The gas flow rate during sintering was 5 Nl/min per 1 kg of the molded articles. The tensile strengths and Charpy impact values for the sintered steels were measured (temperature: 25° C.), and the results are shown in Tables 3-1 and 3-2.

Machinability was evaluated in the following manner. The disk-like molded articles, each having an outer diameter of 60 mm, height of 10 mm and green density of 6.85 g/cm$^3$, were sintered under the conditions as described above, and then drilled by a high-speed drill at 10,000 rpm and 0.012 mm/rev. The average number of holes (mean value of three drills) which could be drilled in the molded articles until drilling became impossible was measured as the tool life, reflecting the machinability of the sintered steels (higher tool life=greater machinability).

The amount of residual graphite in the sintered steels was measured through an infrared ray absorbing method utilizing a glass-filtered residue of nitric acid solvent. The amount of residual graphite, the tool life, the tensile strength, the Charpy impact value and the presence or absence of soot for each example is summarized in Tables 3-1 (examples of the invention) and 3-2 (comparative examples).

It is apparent from Examples 11 to 18 in Table 3-1 that sintered steels having excellent machinability within a tensile strength range of about 400 to 620 MPa can be obtained by sintering iron powders having compositions within the ranges of the present invention.

As shown in Comparative Examples 10 to 21 in Table 3-2, if the total amount of $MoO_3$ powder and $WO_3$ powder added is less than about 0.05 wt % or more than about 0.70 wt %, machinability is deteriorated.

The iron powder of Comparative Example 13 contains no B and a small amount (0.24 wt %) of residual graphite, and the tool life is 510. As compared with the Examples of the invention, it is apparent that machinability is improved by adding B to the iron powder.

As shown in Comparative Examples 14 to 16, if the total content of S, Se and Te is less than about 0.03 wt %, machinability is deteriorated. As shown in Comparative Examples 17 to 19, if the total content of S, Se and Te exceeds about 0.15 wt %, soot is formed in the sintered steels.

As shown in Comparative Example 20, machinability is deteriorated when the content of Mn exceeds 0.1 wt %.

As shown in Comparative Example 21, strength is low and machinability is deteriorated when the amount of graphite added is less than about 0.5 wt %.

According to the present invention, when a mixed iron powder having component quantities within the above-described ranges is sintered, a sintered steel having excellent machinability, strength and toughness can be easily manufactured without forming soot.

Although this invention has been described in connection with specific forms thereof, it will be appreciated that a wide variety of equivalents may be substituted for specific elements described herein without departing from the spirit and scope of the invention defined in the appended claims.

What is claimed is:

1. A mixed iron powder for powder metallurgy, which mixed iron powder comprises:

an iron powder including less than about 0.1 wt % of Mn, about 0.08 to 0.15 wt % of S, and the balance Fe;

said mixed iron powder also comprising a total of about 0.05 to 0.70 wt % of at least one compound selected from the group consisting of $MoO_3$ powder and $WO_3$ powder, said at least one compound present in an amount sufficient for producing a sintered body having excellent machinability and high strength due to dissolution of Mo or W in ferrite particles upon sintering said mixed iron powder in a hydrogen-containing atmosphere, and about 0.50 to 1.50 wt % of graphite powder.

2. A mixed iron powder for powder metallurgy according to claim 1, wherein said iron powder further comprises about 0.02 to 0.07 wt % of Cr and about 0.001 to 0.03 wt % of B.

3. A mixed iron powder for powder metallurgy according to claim 1, wherein the total content of $MoO_3$ and $WO_3$ is about 0.10 to 0.50 wt %.

4. A mixed iron powder for powder metallurgy according to claim 1 or 2, further comprising about 0.50 to 4.0 wt % of copper powder.

5. A mixed iron powder for powder metallurgy, said mixed iron powder comprising:

an iron powder including less than about 0.1 wt % of Mn, a total of about 0.03 to 0.15 wt % of at least one element selected from the group consisting of S, Se and Te, and the balance Fe;

said mixed iron powder also comprising a total of about 0.05 to 0.70 wt % of at least one compound selected from the group consisting of $MoO_3$ powder and $WO_3$ powder, said at least one compound present in an amount sufficient for producinga sintered body having excellent machinability and high strength due to dissolution of Mor or W in ferrite particles upon sintering said mixed iron powder in a hydrogen-containing atmosphere, and about 0.50 to 1.50 wt % of graphite powder.

6. A mixed iron powder for powder metallurgy according to claim 5, wherein said iron powder further comprises about 0.02 to 0.07 wt % of Cr and about 0.001 to 0.03 wt % of B.

7. A mixed iron powder for powder metallurgy according to claim 5, wherein the total content of $MoO_3$ and $WO_3$ is about 0.10 to 0.50 wt %.

8. A mixed iron powder for powder metallurgy according to claim 5 or 6, further comprising about 0.50 to 4.0 wt % of copper powder.

* * * * *